US009844934B2

(12) United States Patent
Veenstra et al.

(10) Patent No.: US 9,844,934 B2
(45) Date of Patent: Dec. 19, 2017

(54) LIQUID JETTING DEVICE

(71) Applicant: OCE-TECHNOLOGIES B.V., Venlo (NL)

(72) Inventors: Hylke Veenstra, Venlo (NL); Theo Hummel, Venlo (NL); Amol Khalate, Venlo (NL); Cor Venner, Venlo (NL); Marko Mihailovic, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/188,699

(22) Filed: Jun. 21, 2016

(65) Prior Publication Data

US 2016/0375683 A1 Dec. 29, 2016

(30) Foreign Application Priority Data

Jun. 29, 2015 (EP) ..... 15174196

(51) Int. Cl.
*B41J 2/045* (2006.01)
*B41J 2/14* (2006.01)

(52) U.S. Cl.
CPC ..... *B41J 2/04551* (2013.01); *B41J 2/04571* (2013.01); *B41J 2/04573* (2013.01); (Continued)

(58) Field of Classification Search
CPC ..... B41J 2/04588
See application file for complete search history.

(56) References Cited

U.S. PATENT DOCUMENTS 5,204,695 A * 4/1993 Tokunaga ..... B41J 2/04553 347/11
6,296,341 B1 * 10/2001 Sugahara ..... B41J 2/04573 347/11

(Continued)

FOREIGN PATENT DOCUMENTS

EP 0 812 693 A1 12/1997
EP 1 013 453 A2 6/2000

(Continued)

*Primary Examiner* — Shelby Fidler
(74) *Attorney, Agent, or Firm* — Birch, Stewart, Kolasch & Birch, LLP

(57) ABSTRACT

A liquid jetting device comprising a plurality of ejection units each of which is arranged to eject a droplet of a liquid and comprises a nozzle, a liquid duct connected to the nozzle and an electro-mechanical transducer arranged to create an acoustic pressure wave in the liquid in the duct, the device further comprising an electronic control system arranged to receive a pressure signal from at least one of the transducers and to generate a transducer control signal on the basis of the received pressure signal and to control the transducers of said plurality of ejection units to operate in a mode of operation selected from a variety of different modes of operation, wherein the control system is arranged to detect an acoustic property of the liquid of the basis of the received pressure signal and to select the mode of operation in accordance with the detected property, the control system being arranged to deliver transducer control signals to the transducers, which control signals are derived from a common basic waveform that is specified by mode parameters, each mode of operation of the device is specified by a different set of mode parameters, the waveform comprises a jetting pulse and quench pulse following on the jetting pulse, and one of the mode parameters is a time delay between the start of the jetting pulse and the start of the quench pulse.

12 Claims, 7 Drawing Sheets

(52) U.S. Cl.
CPC ..... *B41J 2/04581* (2013.01); *B41J 2/04588* (2013.01); *B41J 2/04596* (2013.01); *B41J 2/14008* (2013.01); *B41J 2/14201* (2013.01); *B41J 2002/1437* (2013.01); *B41J 2002/14354* (2013.01)

(56) References Cited

U.S. PATENT DOCUMENTS

| | | | | |
|---|---|---|---|---|
| 6,478,399 | B1 | 11/2002 | Mitsuzawa et al. | |
| 2004/0189732 | A1* | 9/2004 | Usuda | B41J 2/04588 347/19 |
| 2007/0103500 | A1 | 5/2007 | Ootsuka | |
| 2012/0249638 | A1* | 10/2012 | Takano | B41J 2/04588 347/10 |
| 2014/0216141 | A1* | 8/2014 | Zhou | B41J 2/04581 73/54.11 |
| 2015/0258780 | A1* | 9/2015 | Hayashi | B41J 2/04581 347/6 |
| 2016/0236466 | A1* | 8/2016 | Takahashi | B41J 2/04588 |

FOREIGN PATENT DOCUMENTS

| | | | |
|---|---|---|---|
| EP | 1 378 359 | A1 | 1/2004 |
| EP | 1 378 360 | A1 | 1/2004 |
| EP | 2 765 003 | A1 | 8/2014 |
| WO | WO 2007-060634 | A1 | 5/2007 |

* cited by examiner

LIQUID JETTING DEVICE

FIELD OF THE INVENTION

The invention relates to a liquid jetting device and, more particularly, the invention relates to an ink jet printer. Further, the present invention relates to a method of controlling such liquid jetting device and to a cartridge for use in such liquid jetting device.

BACKGROUND OF THE INVENTION

A known liquid jetting device comprises a plurality of ejection units each of which is arranged to eject a droplet of a liquid and comprises a nozzle, a liquid duct connected to the nozzle, and an electro-mechanical transducer arranged to create an acoustic pressure wave in the liquid in the duct.

The electro-mechanical transducer may for example be a piezoelectric transducer forming a part of the wall of the duct. When a voltage pulse is applied to the transducer, this will cause a mechanical deformation of the transducer. As a consequence, an acoustic pressure wave is created in the liquid ink in the duct, and when the pressure wave propagates to the nozzle, an ink droplet is expelled from the nozzle.

EP 1 378 359 A1 and EP 1 378 360 A1 describe ink jet printers which comprise an electronic circuit for measuring the electric impedance of the piezoelectric transducer. Since the impedance of the transducer is changed when the body of the transducer is deformed or exposed to an external mechanical strain, the impedance can be used as a measure of the forces which the liquid in the duct exerts upon the transducer. Consequently, the impedance measurement can be used for monitoring the pressure fluctuations in the ink that are caused by the acoustic pressure wave that is being generated or has been generated by the transducer.

The impedance measurement may be performed in the intervals between successive voltage pulses. In that case, the impedance fluctuations are indicative of the acoustic pressure wave that is gradually decaying in the duct after a droplet has been expelled. This information may then be used for adapting the amplitude of the next voltage pulse, for example.

As has been described in EP 1 013 453 A2, the impedance measurement and the monitoring of the pressure wave in the duct may also be utilized for detecting a breakdown of the ink duct without interrupting the operation of the printer. For example, air bubbles in the ink duct will cause a characteristic signature in the decay pattern of the acoustic wave. Similarly, if the duct is (partially) clogged by a solid particle, this will result in an impedance signal having a lower frequency, a smaller initial amplitude and a stronger damping characteristic.

In the known devices, the measured impedance and the resulting pressure signal are utilized only for controlling the very transducer from which the pressure signal has been obtained. The parameters that are controlled on the basis of the pressure signal relate only to the amplitude and/or shape of the pulses with which this individual transducer is energized. Other operating parameters, in particular the drop generation frequency which determines the printing speed, have to be the same for the transducers of all injection units.

When printing with a high drop generation frequency, a high image quality can be expected only on condition that there is a suitable match between the configuration of the ejection units and the acoustic properties of the ink. If, for example, the viscosity of the ink is not in a suitable range, this may lead to undesired pressure fluctuations in the ink and to cross-talk among neighbouring ejection units, so that the image quality will be compromised.

It is generally known in the art that the control system of the printer may automatically detect the type of ink being used, e.g. on the basis of certain marks on the ink cartridge, and shut down the printer if the ink is not of the correct type. It may also be conceived that the printer is operated with a lower drop generation frequency if the ink is not of the correct type.

SUMMARY OF THE INVENTION

It is an object of invention to provide a jetting device which has a greater tolerance against variations in the acoustic properties of the liquid.

In order to achieve this object, according to the invention, a liquid jetting device is provided wherein the liquid jetting device comprises a plurality of ejection units each of which is arranged to eject a droplet of a liquid and comprises a nozzle, a liquid duct connected to the nozzle, and an electro-mechanical transducer arranged to create an acoustic pressure wave in the liquid in the duct. The device further comprises an electronic control system arranged to receive a pressure signal from at least one of the transducers and to generate a transducer control signal on the basis of the received pressure signal, and to control all the transducers of said plurality of ejection units to operate in a mode of operation selected from a variety of different modes of operation, wherein the control system is arranged to detect an acoustic property of the liquid of the basis of the received pressure signal and to select the mode of operation in accordance with the detected property. The control system is arranged to deliver transducer control signals to the transducers, which control signals are derived from a common basic waveform that is specified by mode parameters, each mode of operation of the device is specified by a different set of mode parameters. The waveform comprises a jetting pulse and quench pulse following on the jetting pulse and one of the mode parameters is a time delay between the start of the jetting pulse and the start of the quench pulse.

The pressure signal that has been received from one transducer or optionally from a plurality of transducers is utilized for determining a relevant acoustic property of the liquid that is currently being used, and then a mode of operation for all the ejection units of the device, i.e. not only those from which the pressure signals have been received, is selected on the basis of the identified acoustic property of the liquid. This permits to optimize the operation of the device in view of the specific properties of the liquid (ink) that is currently being used.

In particular, a quench pulse is known to be used for suppressing a residual pressure wave in the liquid prior to a subsequent jetting pulse. A timing of the quench pulse is important for suitable suppression. Moreover, with an incorrect timing of the quench pulse, instead of suppressing, the residual pressure wave may be amplified. Insufficiently suppressed or even amplified residual pressure waves result in strongly deviating droplet properties (e.g. droplet size and droplet speed) for the droplet generated by the subsequent jetting pulse, which is of course undesirable.

As the timing depends inter alia on the properties of the liquid, the timing of the quench pulse (i.e. a time delay between the start of the jetting pulse and the start of the quench pulse) is selected as a mode parameter. So, the timing of the quench pulse is adapted to the specific properties of the liquid (ink) that is currently used.

In general, the acoustic properties of the liquid will determine a characteristic pattern according to which the pressure wave in the duct of an ejection unit decays in the time following on an energizing pulse. Thus, the acoustic properties of the liquid and the most suitable mode of operation for that liquid can be determined by analyzing the pattern of the pressure signal.

In one embodiment, a number of standard patterns that describe the properties of available inks of different types may be stored in advance together with an identification of a mode of operation, e.g. an identification in the form of a set of mode parameters, that is recommended for that type of ink. Then, when an ink cartridge has been inserted and the printer is started (in a default mode of operation), the pressure signal from one or more transducers will be recorded, and the recorded signal will be compared to the standard pattern in order to identify the type of ink that is currently being used, and then to select the appropriate mode parameters.

In one embodiment, the control system may always select the mode parameters that are linked to the standard pattern that fits best with the recorded pressure signal.

In another embodiment, it may be required that the correlation between the recorded pressure signal and the standard pattern must exceed a certain minimum in order for the pattern and the linked mode parameters to be selected. Then, it may of course happen that no pattern can be found that fits sufficiently well. This would mean that the user tries to operate the device with a liquid of an unknown type, i.e. a type for which no standard pattern has been stored.

In that case, the device may simply be shut down or switched to a safe mode in which it operates only with a sufficiently low drop generation frequency, and hence low printing speed.

In a more elaborated embodiment it is possible, however, that the control system automatically adapts to the new type of ink by varying the mode parameters and the combination of mode parameters until a mode of operation has been found that is most suitable for that type of ink.

Useful details and preferred embodiments of the invention are indicated in the dependent claims.

A method of controlling the jetting device is claimed in an independent method claim.

BRIEF DESCRIPTION OF THE DRAWINGS

Embodiment examples of the invention will now described in conjunction with the drawings, wherein.

DETAILED DESCRIPTION OF THE DRAWINGS

Figure 1:
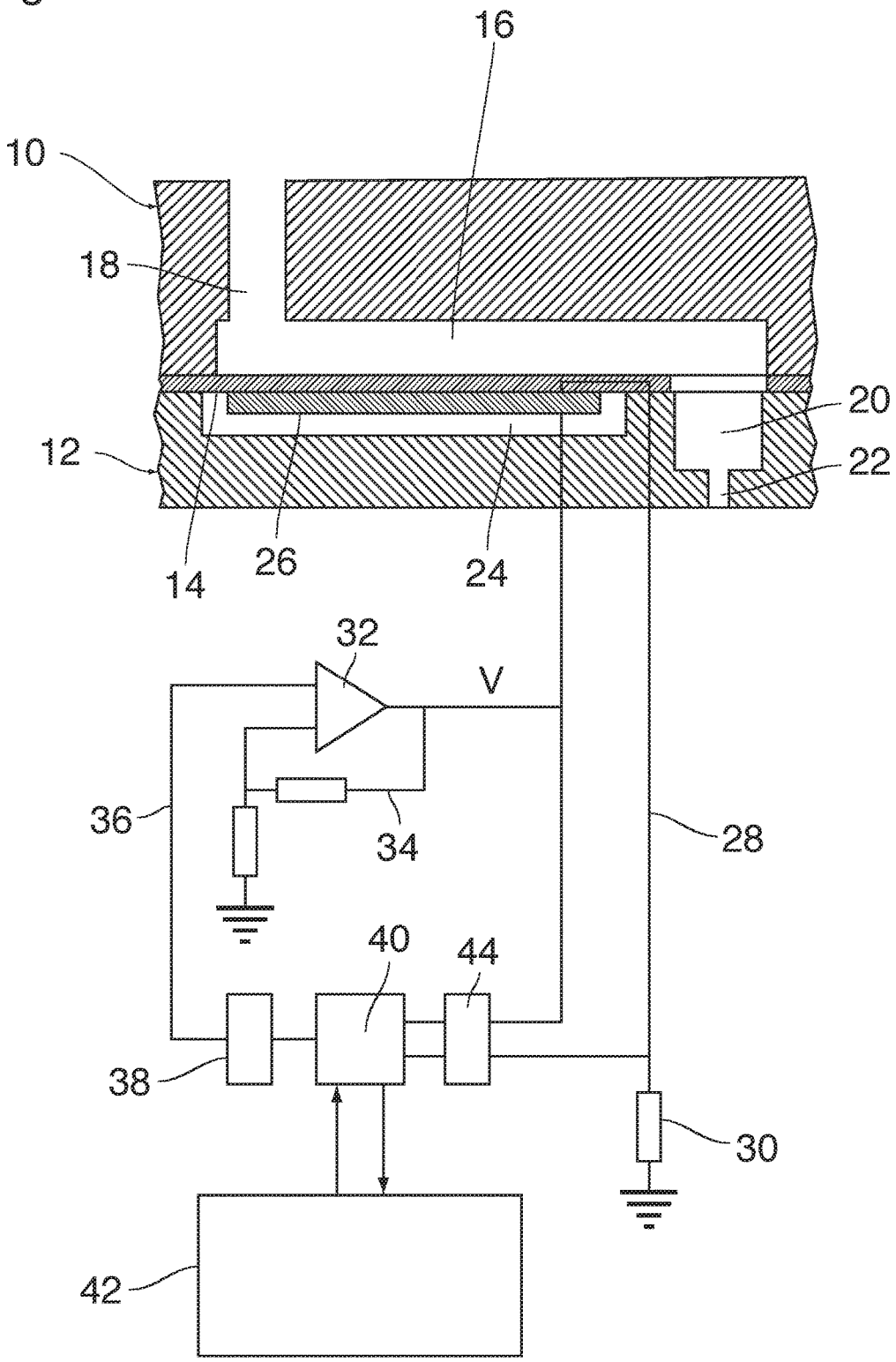
FIG. 1 is a cross-sectional view of an ejection unit of a jetting device according to the invention, together with an electronic circuit for controlling the device.

FIG. 1 shows a single ejection unit of an ink jet print head. The print head constitutes an example of a jetting device according to the invention. The device comprises a wafer 10 and a support member 12 that are bonded to opposite sides of a thin flexible membrane 14.

A recess that forms an ink duct 16 is formed in the face of the wafer 10 that engages the membrane 14, e.g. the bottom face in FIG. 1. The ink duct 16 has an essentially rectangular shape. An end portion on the left side in FIG. 1 is connected to an ink supply line 18 that passes through the wafer 10 in thickness direction of the wafer and serves for supplying liquid ink to the ink duct 16.

An opposite end of the ink duct 16, on the right side in FIG. 1, is connected, through an opening in the membrane 14, to a chamber 20 that is formed in the support member 12 and opens out into a nozzle 22 that is formed in the bottom face of the support member.

Adjacent to the membrane 14 and separated from the chamber 20, the support member 12 forms another cavity 24 accommodating a piezoelectric transducer 26 that is bonded to the membrane 14.

The piezoelectric transducer 26 has electrodes (not shown in detail) that are connected to an electronic circuit that has been shown in the lower part of FIG. 1. In the example shown, one electrode of the transducer is grounded via a line 28 and a resistor 30. Another electrode of the transducer is connected to an output of an amplifier 32 that is feedback-controlled via a feedback network 34, so that a voltage V applied to the transducer will be proportional to a signal on an input line 36 of the amplifier. The signal on the input line 36 is generated by a D/A-converter 38 that receives a digital input from a local digital controller 40. The controller 40 is connected to a processor 42.

When an ink droplet is to be expelled from the nozzle 22, the processor 42 sends a command to the controller 40 which outputs a digital signal that causes the D/A-converter 38 and the amplifier 32 to apply a voltage pulse to the transducer 26. This voltage pulse causes the transducer to deform in a bending mode. More specifically, the transducer 26 is caused to flex downward, so that the membrane 14 which is bonded to the transducer 26 will also flex downward, thereby to increase the volume of the ink duct 16. As a consequence, additional ink will be sucked-in via the supply line 18. Then, when the voltage pulse falls off again, the membrane 14 will flex back into the original state, so that a positive acoustic pressure wave is generated in the liquid ink in the duct 16. This pressure wave propagates to the nozzle 22 and causes an ink droplet to be expelled.

The electrodes of the transducer 26 are also connected to an A/D converter 44 which measures a voltage drop across the transducer and also a voltage drop across the resistor 38 and thereby implicitly the current flowing through the transducer. Corresponding digital signals are forwarded to the controller 40 which can derive the impedance of the transducer 26 from these signals. The measured impedance is signalled to the processor 42 where the impedance signal is processed further, as will be described below.

The acoustic wave that has caused a droplet to be expelled from the nozzle 22 will be reflected (with phase reversal) at the open nozzle and will propagate back into the duct 16. Consequently, even after the droplet has been expelled, a gradually decaying acoustic pressure wave is still present in the duct 16, and the corresponding pressure fluctuations exert a bending stress onto the membrane 14 and the actuator 26. This mechanical strain on the piezoelectric transducer leads to a change in the impedance of the transducer, and this change can be measured with the electronic circuit described above. The measured impedance changes represent the pressure fluctuations of the acoustic wave and can therefore be used to derive a pressure signal P that describes these pressure fluctuations.

Figure 2:
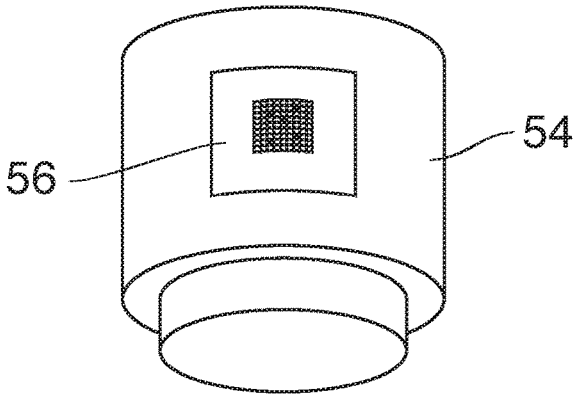
FIG. 2 is a view, partly in a cross-section, of a larger part of the jetting device with a plurality of ejection units, together with an ink cartridge.
Figure 2:
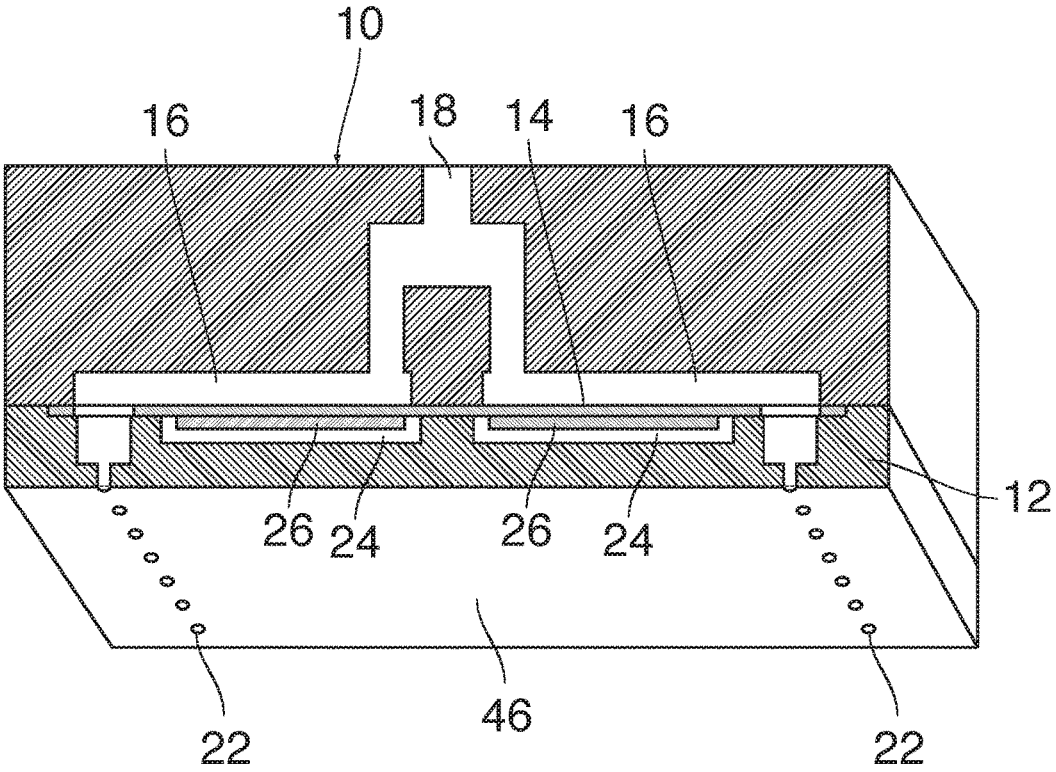

As is shown in FIG. 2, the print head has a plurality of ejection units that are arranged in mirror-symmetric pairs so as to form two parallel rows of nozzles 22 in a common nozzle face 46. The electrodes of the transducers 26 of all of these ejection units are connected to a circuitry corresponding to the one shown in FIG. 1 for applying energizing pulses to the transducers. However, the circuitry comprising the A/D converter 44 for measuring a pressure signal is not necessarily provided for all of the transducers, although it is preferred that such circuits are provided for a larger number of transducers that are evenly distributed over the nozzle face 46.

Ideally, the ink ducts 16, the membrane 14 and the transducers 26 should have identical acoustic properties for all ejection units of the device, so that a common control signal consisting of energizing pulses with a common waveform could be applied to the transducers of all ejection units that are to fire at the same time. In practice, however, the acoustic properties of the ejection units may slightly differ from one another due to the presence of solid particles or air bubbles in the ink ducts and/or to uneven ageing of the mechanical components. When the circuitry for measuring the pressure signals is provided for all ejection units, these differences may be detected by analysing these pressure signals, and the differences may at least partly be compensated by individually varying the amplitudes of the energizing pulses for the transducers. Nevertheless, the control signals applied to all the transducers 26 may be derived from a common basic signal that is supplied from the processor 42 and has a basic waveform, the shape of which can be specified by a set of mode parameters, as will now be explained in conjunction with FIG. 3.

Figure 3:
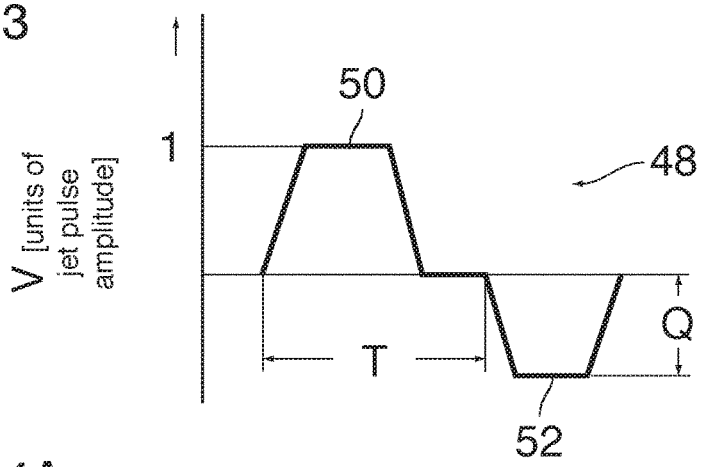
FIG. 3 shows a basic waveform of an energizing pulse to be applied to transducers of the jetting device.

As is shown in FIG. 3, a waveform 48 of an energizing pulse which is applied to a transducer whenever a droplet is to be expelled from the corresponding ejection unit comprises a jet pulse 50 followed by a so-called quench pulse 52. The jet pulse 50 has the purpose to excite the acoustic wave that will result in the ejection of the droplet, whereas the quench pulse 52 is designed to promote the attenuation of the acoustic wave that will still oscillate in the ink duct when the droplet has been expelled. This is why the polarity of the quench pulse 52 is opposite to that of the jet pulse 50, and its amplitude is lower because part of the acoustic wave would be dampened anyway even without quench pulse, due to the viscosity of the liquid.

The waveform 48 can be specified by two mode parameters: a pulse period T specifying the time delay between the start of the jet pulse 50 and the start of the subsequent quench pulse 52, and a quench factor Q specifying the amplitude of the quench pulse 52 relative to that of the jet pulse 50. Each pair of mode parameters T, Q specifies a mode of operation for all ejection units of the device, whereas the amplitudes of the jet pulses 50 may optionally be varied for each individual transducer. In this example, the durations of the jet pulse 50 and the quench pulse 52 are constant. Thus, the pulse period T will determine the highest possible drop generation frequency. In other embodiments, the duration of the jet pulse and the duration of the quench pulse relative to that of the jet pulse may be further mode parameters that could be varied.

When the printer is started-up and no information on the type of ink is available, the printer will operate in a default mode specified by a certain set of mode parameters T and Q. Then, when the first droplets of ink have been ejected, the pressure signal P reflecting the pressure fluctuations in the ink duct 16 of at least one ejection unit will be recorded as a function of time t.

Figure 4A:
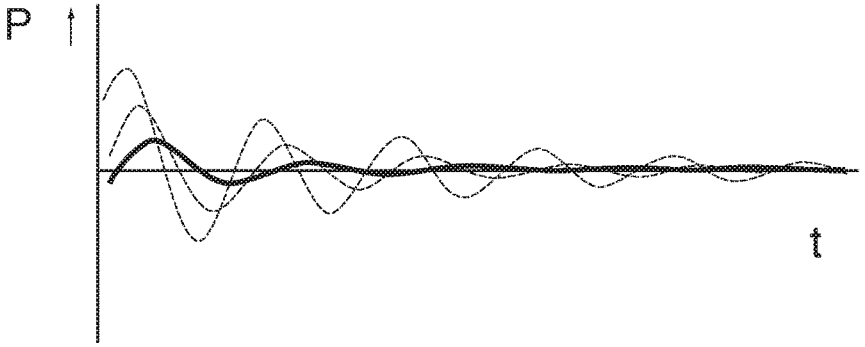
FIG. 4A is a time diagram showing acoustic pressure waves that are obtained from an ejection unit of the jetting device when liquids of different types are used for jetting.

FIG. 4A shows examples of three pressure signals which have been obtained for three different inks in the same mode of operation of the printer, i.e. the default mode. It can be seen that the pressure signals generally have the shape of a decaying sinusoidal oscillation. However, the amplitude, the frequency, and the decay rate are different for the different inks. The curve that has been drawn in bold lines in FIG. 4A represents a certain ink "ink 1" has the smallest amplitude and the lowest frequency.

Figure 4B:
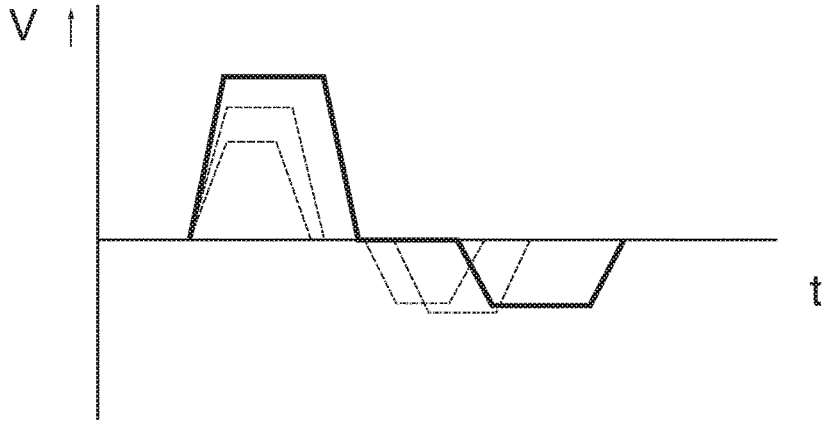
FIG. 4B is a time diagram showing shapes of energizing pulses adapted to the types of liquid for which the pressure waves in FIG. 3A have been obtained.
Figure 5A:
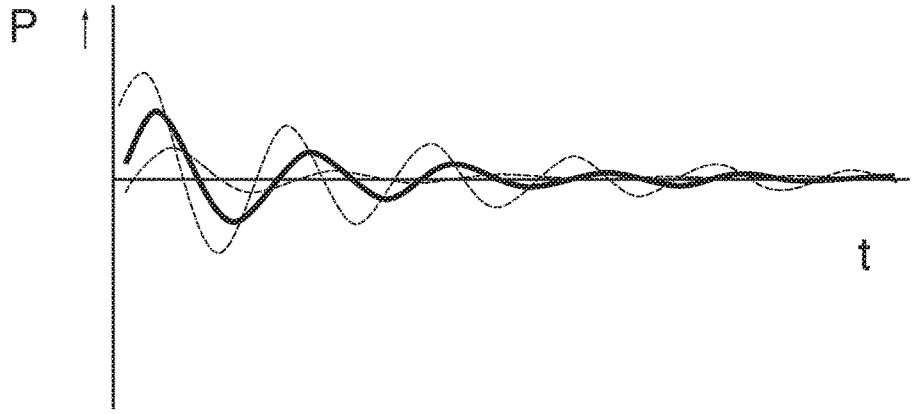
FIGS. 5A to 6B are diagrams analogous to those in FIGS. 3A and 3B.
Figure 5B:
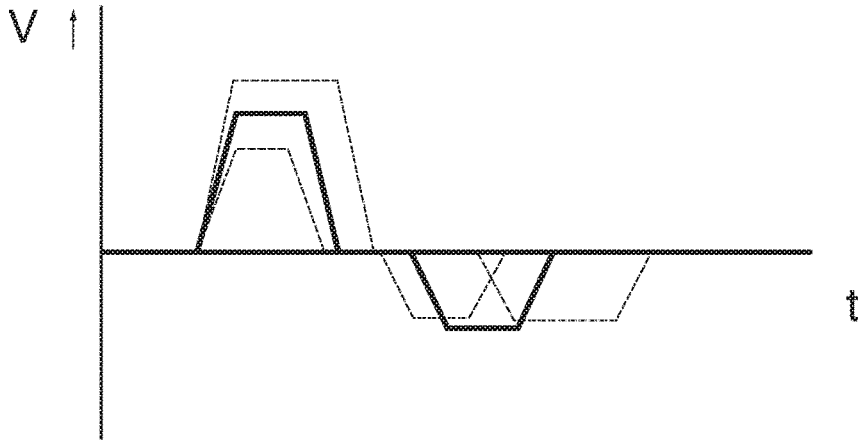

FIG. 4B shows waveforms for the energizing pulses that have been optimized for the three different inks for which the pressure signals in FIG. 4A have been obtained. The wave form for "ink 1" has again been shown in bold lines. It can be seen that the pulse period T is large, the jet pulse has a high amplitude and the quench factor is relatively small.

Figure 6A:
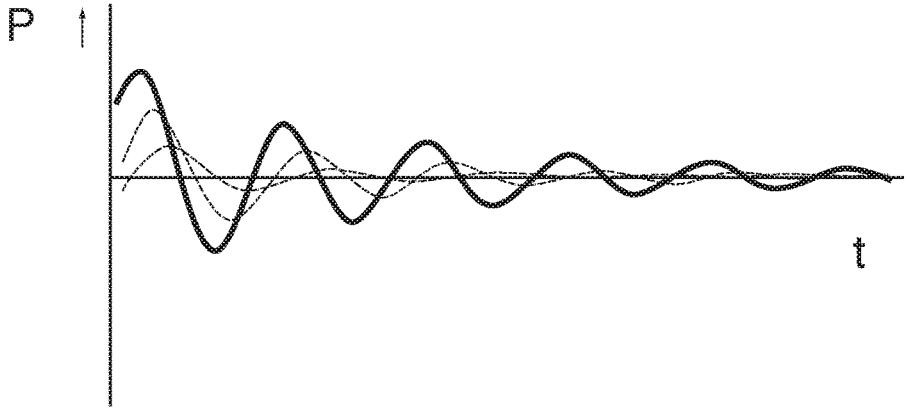
Figure 6B:
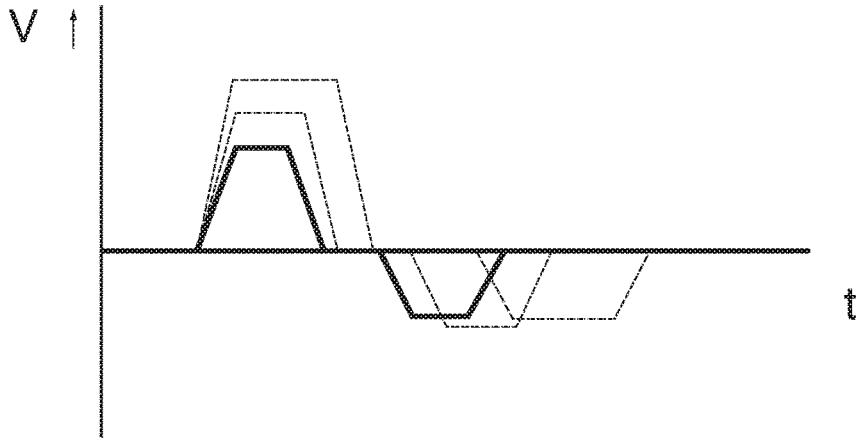

FIGS. 5A and 5B and FIGS. 6A and 6B show the same curves as FIGS. 4A and 4B, but in each case the curves for another ink ("ink 2" in FIGS. 5A and 5B and "ink 3" in FIGS. 6A and 6B) have been shown in bold lines. It can be seen that the optimized waveform for "ink 2" has a smaller pulse period T (that means a larger drop generation frequency) and a lower jet pulse amplitude than the waveform for "ink 1". On the other hand, the quench factor Q (amplitude ratio between the quench pulse and the jet pulse) is larger. As is shown in FIGS. 6A and 6B, the optimized waveform for "ink 3" has the smallest pulse period, the smallest jet pulse amplitude and the largest quench factor.

For a given selection of inks, the optimized mode parameters T, Q can be determined by experiment.

An example of a method of controlling the ink jet printer that has been described above will now be explained by reference to the flow diagrams shown in FIGS. 7 and 8.

Figure 7:
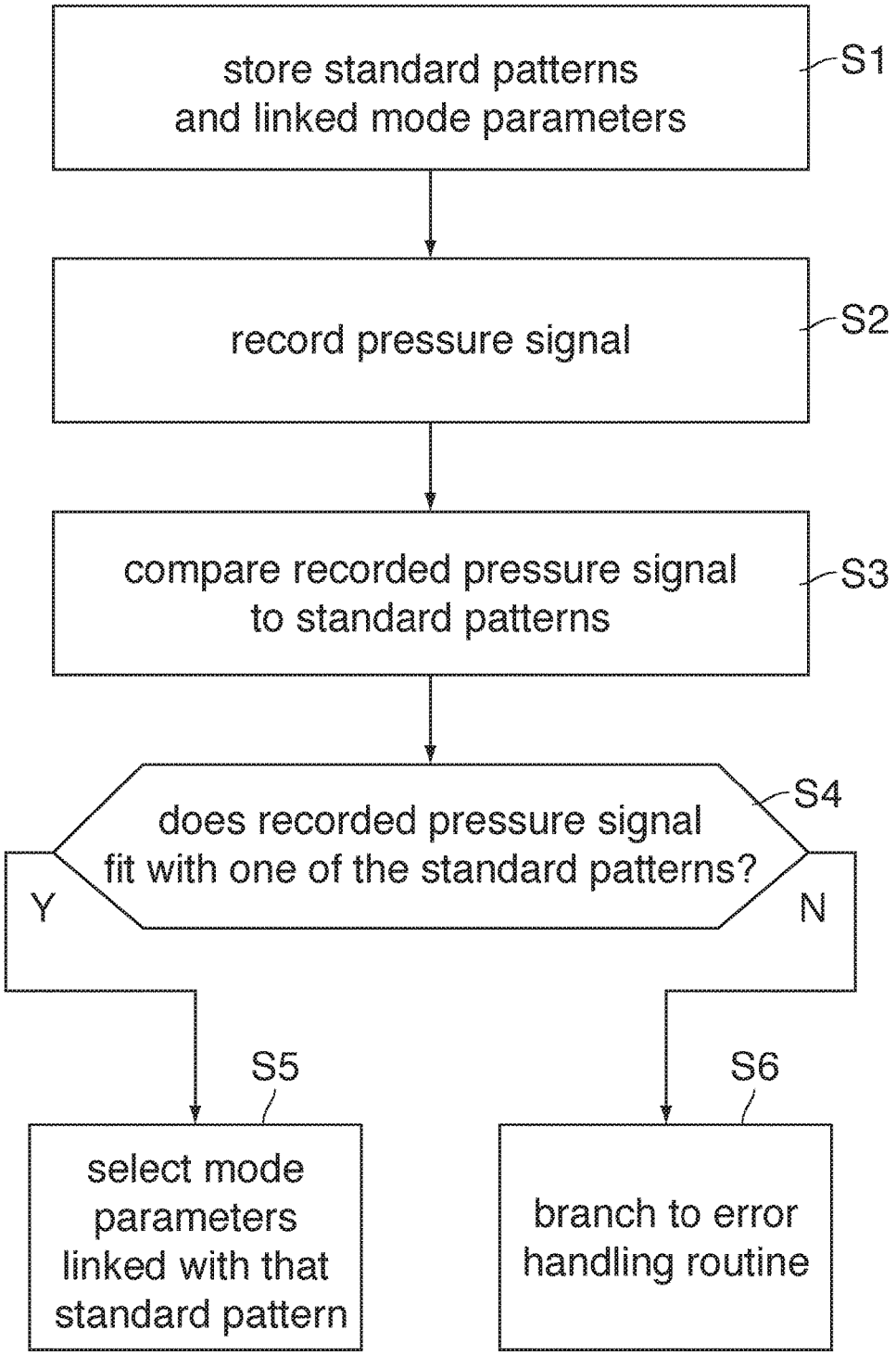
FIGS. 7 and 8 are flow diagrams for a method of controlling the jetting device.

Step S1 in FIG. 7 is a preparatory step that needs to be performed only once before the printer is put to use. In this step, pressure signals P of the type shown in FIG. 4A for a selection of inks with which the printer might be operated are recorded and stored in a memory of the processor 42 as standard patterns. Further, the optimal mode parameters T and Q are determined for each of these inks, and each of the stored standard patterns is linked with the corresponding pair of mode parameters T and Q.

Of course, when the printer has been used for a certain time, the step S1 may be repeated whenever there is a need to add more inks.

Step S2 in FIG. 7 is performed when the printer has been switched on and an image is to be printed. In this step, the printer is in the default mode, and ink droplets are ejected from several of the ejection units, while the pressure signal P from at least one of the transducers is recorded. Preferably, the pressure signals of several transducers are recorded, and the recorded signals are averaged so as to reduce the effect of statistical fluctuations.

Then, in step S3, the recorded pressure signal is compared to each of the standard patterns that had been stored in step S1, in order to identify the ink that is presently loaded in the printer, i.e. the ink the standard pattern of which is practically identical with the recorded pressure signal.

In step S4, it is checked whether the recorded pressure signal fits with sufficient accuracy with one of the standard patterns. The accuracy limits are defined so narrow that a given pressure signal can only fit with one of the standard patterns or with none of them.

When a fitting standard pattern has been found (Y in step S4), the mode parameters T and Q linked with that pattern are selected in step S5, and the printer is switched to a mode of operation that is specified by these parameters.

It will be understood that these steps will be completed as soon as the first few ink droplets of a first image have been printed, and from that moment on the operating mode of the printer will be optimally adjusted to the ink. Of course, the steps S1-S5 may be repeated from time to time in order to check whether the ink or a relevant property of the ink has changed.

If no fitting standard pattern has been found in step S4 (N), this means that the ink that is presently being used in the printer is not yet included in the data base storing the standard patterns and the related mode parameters, and the routine branches to an error handling routine in step S6. In the simplest case, the error handling routine may consist in shutting the printer down. In another embodiment, the error handling routine may consist in switching the printer to a safe mode of operation, i.e. a mode with a relatively low drop generation frequency (hence a low printing speed), so that a satisfactory image quality can be obtained for practically all types of ink.

Figure 8:
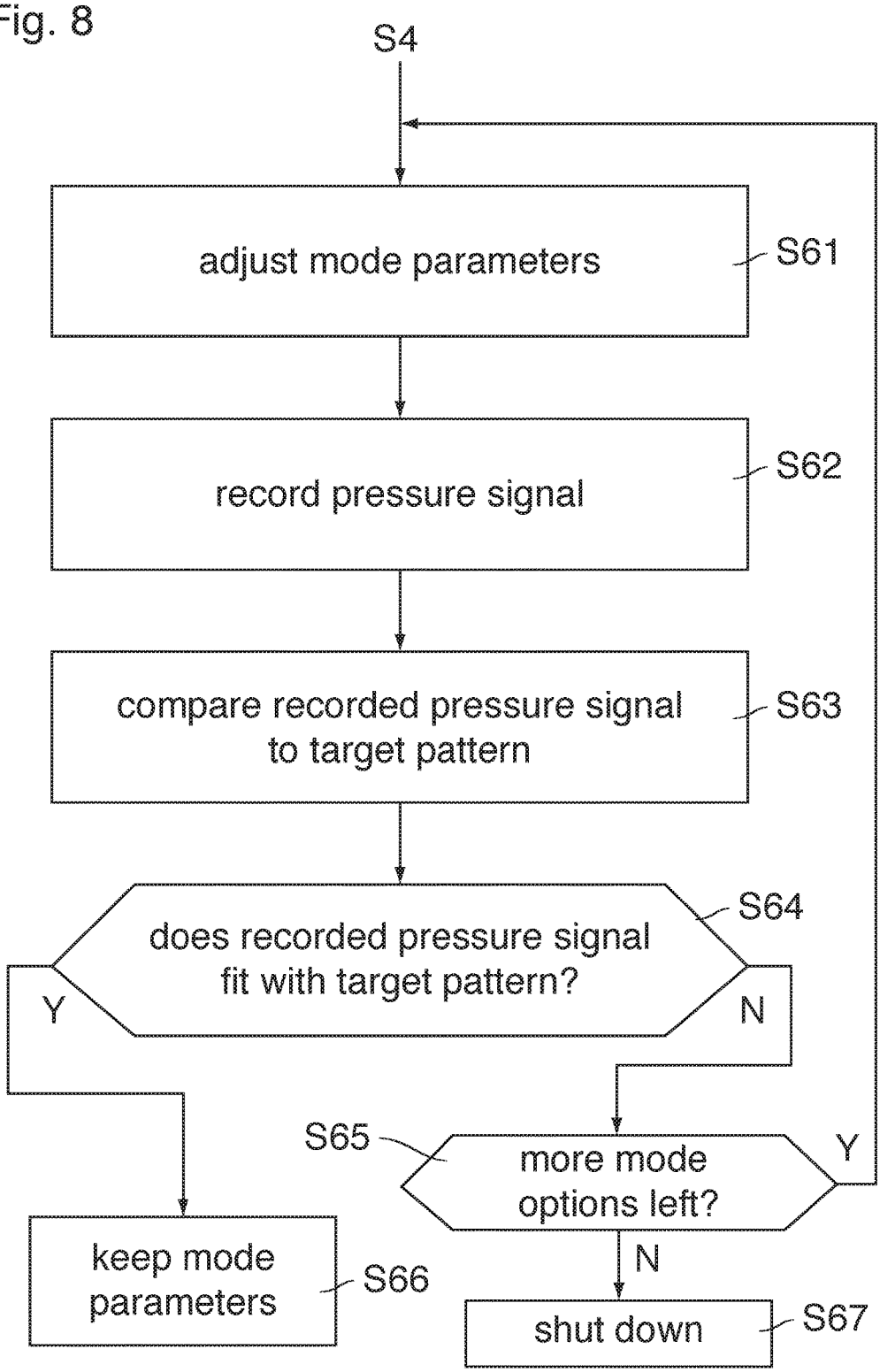

Another example of an error handling routine has been illustrated in FIG. 8. According to this routine, when the result "N" has been obtained in step S4, printing is continued, but the mode parameter is adjusted by slightly changing a value of T and/or the value of Q in step S61. Then, in step S62, the pressure signal is recorded again, and the recorded pressure signal is compared to a target pattern in step S63. The term "target pattern" designates one of the patterns that is stored in the processor 42 and represents the case that the mode parameters are optimally adjusted to the ink. For example, the default mode in which the step S1 has been performed will be a mode that is optimal for a certain type of ink (preferably an ink that is frequently used) so that the pressure signal P that has been obtained in step S1 for that specific ink will be the target pattern.

In step S64, it is checked whether the pressure signal recorded in step S62 fits (with sufficient accuracy) with the target pattern. If that is not the case (N), then the routine branches to a step S65, and the steps S61-S65 are repeatedly looped-through in order to test all possible combinations of mode parameters, until the optimal parameter combination has been found. It will be understood that each of the mode parameters (T and Q in this example) can assume a finite number of different values. Then, all possible pairs of values for T and Q form a set of mode options that can be tested. Step S65 is a check whether all available mode options have been tested already.

When an optimal combination of mode parameters has been found, the result will be "Y" in step S64, and the mode parameters as last adjusted in step S61 are kept for printing in step S66. On the other hand, if all mode options have been tested and no pressure signal fitting with the target pattern has been found (N in step S65), then the printer is shut down or switched to a safe mode in step S67.

This error handling routine permits the printer to automatically adapt to a new or unknown ink.

In a modified embodiment, step S67 may be replaced by a step in which the combination of mode parameters that has produced the best fit in step S64 is selected for printing.

In the embodiment shown in FIG. 8, all possible mode options are tested. However, some shortcuts are possible by applying heuristic rules. For example, when it is found in step S62 that the frequency of the recorded pressure signal is smaller than the frequency according to the target pattern, then it will be useless to test any parameter combinations where the pulse period T is even shorter, so that these mode options can be excluded.

When a manufacturer markets a new type of ink, it is desirable to provide an easy way for updating the data base that has been formed in step S1 in FIG. 7. To that end, the new ink may be tested in the printer, and the resulting pressure signal may be recorded. The optimal mode parameters for this ink may be determined experimentally, and a data tag, e.g. a QR code tag, an RFID tag or the like may be attached to the cartridges in which the ink is delivered. As an example, FIG. 2 shows an ink cartridge 54 that may be plugged into a socket of the print head and carries a data tag 56 on which the standard pattern for that ink and the related mode parameters are encoded in machine readable form. The printer has a tag reader for reading the information from the tag 56 and adding these data to the database that stores also the standard patterns and mode parameters for the other inks. In this way, the printer will be capable of recognizing the new ink whenever it is used in the printer, even when it is delivered in a cartridge that is not tagged.

The invention claimed is:

1. A liquid jetting device comprising a plurality of ejection units each of which is arranged to eject a droplet of a liquid and comprises a nozzle, a liquid duct connected to the nozzle and an electro-mechanical transducer arranged to create an acoustic pressure wave in the liquid in the duct, the device further comprising an electronic control system arranged to receive a pressure signal from at least one of the transducers and to generate a transducer control signal on the basis of the received pressure signal and to control the transducers of said plurality of ejection units to operate in a mode of operation selected from a variety of different modes of operation, wherein operating in the mode of operation comprises using a particular set of mode parameters;

wherein the control system is further arranged to perform a preparatory step of recording a number of standard patterns corresponding to pressure signals that are expected for different liquids together with an identification of the mode of operation and describing how the pressure wave in the duct of an ejection unit decays in the time following on an energizing pulse;

wherein the control system is further arranged to perform, when the jetting device is operated with a given liquid, recording the pressure signal and comparing it to the standard patterns and selecting the mode of operation that is linked with the standard pattern that fits with the recorded pressure signal;

wherein the control system is arranged to detect an acoustic property of the liquid of the basis of the received pressure signal and to select the mode of operation in accordance with the detected property, the control system being arranged to deliver transducer control signals to the transducers, which control signals are derived from a common basic waveform that is specified by mode parameters, each mode of operation of the device is specified by a different set of mode parameters, the waveform comprises a jetting pulse and quench pulse following on the jetting pulse, and one of the mode parameters is a pulse period which is a time delay between the start of the jetting pulse and the start of the quench pulse, and wherein the pulse period is longer than a pulse duration of the jetting pulse.

2. The jetting device according to claim 1, the jetting device being an ink jet printer.

3. The jetting device according to claim 1, wherein another of the mode parameters is an amplitude ratio between the quench pulse and the jetting pulse.

4. An ink cartridge for use with a liquid jetting device according to claim 1, the cartridge bearing a machine readable data tag encoding a standard pattern that describes how the pressure wave in the duct of an ejection unit decays in the time following on an energizing pulse, the target pattern representing a pressure signal that is to be expected when the jetting device is operated with an ink contained in the cartridge, as well as an identifier for the mode of operation that is best suited for that ink.

5. The jetting device according to claim 1, wherein another of the mode parameters is the duration of the jet pulse.

6. The jetting device according to claim 1, wherein another of the mode parameters is the duration of the quench pulse relative to the duration of the jet pulse.

7. The jetting device according to claim 1, wherein selecting the mode of operation in accordance with the detected property requires that the correlation between the recorded pressure signal and the standard pattern exceeds a minimum.

8. A method of controlling a liquid jetting device comprising a plurality of ejection units each of which is arranged to eject a droplet of a liquid and comprises a nozzle, a liquid duct connected to the nozzle and an electro-mechanical transducer arranged to create an acoustic pressure wave in the liquid in the duct, the device further comprising an electronic control system arranged to receive a pressure signal from at least one of the transducers and to generate a transducer control signal on the basis of the received pressure signal and to control the transducers of said plurality of ejection units to operate in a mode of operation selected from a variety of different modes of operation, wherein operating in the mode of operation comprises using a particular set of mode parameters, the method comprising the steps of:

a preparatory step of recording a number of standard patterns corresponding to pressure signals that are expected for different liquids together with an identification of the mode of operation and describing how the pressure wave in the duct of an ejection unit decays in the time following on an energizing pulse;

when the jetting device is operated with a given liquid, recording the pressure signal and comparing it to the standard patterns and selecting the mode of operation that is linked with the standard pattern that fits with the recorded pressure signal;

detecting an acoustic property of the liquid of the basis of the received pressure signal;

selecting the mode of operation in accordance with the detected property; and delivering control transducer signals to the transducers, wherein the control signals are derived from a common basic waveform that is specified by mode parameters, each mode of operation of the device is specified by a different set of mode parameters, the waveform comprises a jetting pulse and quench pulse following on the jetting pulse, and one of the mode parameters is a pulse period which is a time delay between the start of the jetting pulse and the start of the quench pulse, and wherein the pulse period is longer than a pulse duration of the jetting pulse.

9. The method according to claim 8, wherein another of the mode parameters is an amplitude ratio between the quench pulse and the jetting pulse.

10. The method according to claim 8, wherein another of the mode parameters is the duration of the jet pulse.

11. The method according to claim 8, wherein another of the mode parameters is the duration of the quench pulse relative to the duration of the jet pulse.

12. The method according to claim 8, wherein selecting the mode of operation in accordance with the detected property requires that the correlation between the recorded pressure signal and the standard pattern exceeds a minimum.

* * * * *